US011412819B2

(12) United States Patent
Dobashi

(10) Patent No.: US 11,412,819 B2
(45) Date of Patent: Aug. 16, 2022

(54) CLASP FOR ACCESSORY

(71) Applicant: Crossfor Co., Ltd., Kofu (JP)

(72) Inventor: Hidetaka Dobashi, Kofu (JP)

(73) Assignee: Crossfor Co., Ltd., Kofu (JP)

( * ) Notice: Subject to any disclaimer, the term of this patent is extended or adjusted under 35 U.S.C. 154(b) by 137 days.

(21) Appl. No.: 16/603,657

(22) PCT Filed: Oct. 29, 2018

(86) PCT No.: PCT/JP2018/040165
§ 371 (c)(1),
(2) Date: Oct. 8, 2019

(87) PCT Pub. No.: WO2020/070902
PCT Pub. Date: Apr. 9, 2020

(65) Prior Publication Data

US 2021/0219673 A1 Jul. 22, 2021

(30) Foreign Application Priority Data

Oct. 3, 2018 (JP) ..... JP2018-188060

(51) Int. Cl.
*A44C 5/20* (2006.01)

(52) U.S. Cl.
CPC ..... *A44C 5/2038* (2013.01); *A44C 5/2042* (2013.01)

(58) Field of Classification Search
CPC .... A44C 5/2038; A44C 5/2042; A44C 5/2033
See application file for complete search history.

(56) References Cited

U.S. PATENT DOCUMENTS 1,637,699 A 8/1927 Lauterbach
1,784,635 A 12/1930 Kreisler
(Continued)

FOREIGN PATENT DOCUMENTS

CN 205568073 U 9/2016
GB 191207200 A 1/1913
(Continued)

OTHER PUBLICATIONS

International Search Report dated Nov. 27, 2018 in corresponding International Application No. PCT/JP2018/040165; 2 pages.
(Continued)

*Primary Examiner* — Jack W Lavinder
(74) *Attorney, Agent, or Firm* — Maier & Maier, PLLC

(57) ABSTRACT

A clasp includes a first clasp member and a second clasp member that are separable. The first clasp member includes a first connecting portion to which a linear member is connected, and a first coupling portion that is formed with the first connecting portion. The second clasp member includes a second connecting portion to which the linear member is connected, a second body portion that is continuous from the second connecting portion, a second coupling portion that extends from the second body portion in a direction away from the second connecting portion, and that has a hook shape to be coupled to the first coupling portion, an opening-and-closing portion that is pivotally supported by the second body portion, and that includes an abutment portion, and which is brought into abutment against the second coupling portion, and a locking portion that maintains a state of the abutment of the opening-and-closing portion.

18 Claims, 5 Drawing Sheets

(56) References Cited

U.S. PATENT DOCUMENTS

| | | | | | |
|---|---|---|---|---|---|
| 2,205,092 | A * | 6/1940 | Haeffner | A44B 11/28 24/601.5 |
| 2,211,018 | A * | 8/1940 | Levine | A44C 5/2042 24/601.5 |
| 2,554,184 | A * | 5/1951 | Gerstenblith | A44C 5/2042 24/601.5 |
| 2,586,758 | A | 2/1952 | Zerr | |
| 2,874,435 | A | 2/1959 | Nielsen | |
| 3,358,340 | A | 12/1967 | Higuchi | |
| 3,404,440 | A * | 10/1968 | Weiss | A44C 5/2042 24/601.5 |
| 5,168,606 | A | 12/1992 | Ziemells | |
| 5,279,021 | A | 1/1994 | Edgin | |
| 5,832,571 | A | 11/1998 | Kanamori | |
| 6,202,267 | B1 * | 3/2001 | Collins | A44C 5/2033 24/598.5 |
| D489,247 | S | 5/2004 | Oyster et al. | |
| 2016/0324276 | A1 * | 11/2016 | Collins | A44C 5/2038 |

FOREIGN PATENT DOCUMENTS

| | | | |
|---|---|---|---|
| JP | S44-18616 | Y1 | 8/1969 |
| JP | 49-122256 | U | 10/1974 |
| JP | 1977-115495 | A | 9/1977 |
| JP | S53-048152 | Y1 | 11/1978 |
| JP | 56-047381 | Y | 11/1981 |
| JP | H05-293005 | A | 11/1993 |
| JP | H07-27182 | A | 1/1995 |
| JP | 08320053 | A | 12/1996 |
| JP | H10-137016 | A | 5/1998 |
| JP | 2000-166625 | A | 6/2000 |
| JP | 2007-195606 | A | 8/2007 |
| JP | 3136049 | U | 10/2007 |
| JP | 2008-36244 | A | 2/2008 |
| JP | 2012-19946 | A | 2/2012 |
| JP | 2018-108299 | A | 7/2018 |

OTHER PUBLICATIONS

Search Report dated Nov. 27, 2020 in corresponding European Application No. 18915785.2; 8 pages.
International Search Report dated Oct. 15, 2019 in corresponding International Application No. PCT/JP2019/026859; 2 pages.
Translation of Written Opinion dated Oct. 15, 2019 in corresponding International Application No. PCT/JP2019/026859; 7 pages.
Translation of Written Opinion dated Dec. 12, 2019 in corresponding International Application No. PCT/JP2019/034614; 9 pages.
Chinese Office Action dated Mar. 3, 2021, in connection with corresponding CN Application No. 201910892205.8 (20 pp., including machine-generated English translation).
Chinese Office Action dated Jun. 10, 2021, in connection with corresponding CN Application No. 201880003189.6 (12 pp., including machine-generated English translation).
Chinese Office Action dated Jun. 22, 2021, in connection with corresponding CN Application No. 201980004809.2 (14 pp., including machine-generated English translation).
Korean Office Action dated Jul. 26, 2021, in connection with corresponding KR Application No. 10-2020-7008417 (10 pp., including machine-generated English translation).
Korean Office Action dated Jul. 26, 2021, in connection with corresponding KR Application No. 10-2020-7008418 (13 pp., including machine-generated English translation).
Chinese Office Action dated Oct. 18, 2021, in connection with corresponding CN Application No. 201910892205.8 (22 pp., including machine-generated English translation).
Search Report dated Jan. 14, 2022 in corresponding European Application No. 19869076.0; 8 pages.
Examination Report dated Apr. 18, 2022 in corresponding Indian Application No. 202047047490; 7 pages.

* cited by examiner

CLASP FOR ACCESSORY

FIELD

The present invention relates to a clasp for an accessory such as a necklace or a bracelet, the clasp separating one end portion and another end portion of a linear member of the accessory from each other, and coupling these end portions to each other.

BACKGROUND ART

Hitherto, the accessory such as the necklace or the bracelet is put on by wrapping the linear member such as a chain member or a string member around, for example, the neck or an arm. A clasp including a pair of clasp members capable of being coupled to and separated from each other are attached to the one end portion and the other end portion of the linear member of the accessory. By separating the pair of clasp members from each other and coupling the pair of clasp members to each other, the accessory can be put on and taken off.

As types of the clasp to be used in such an accessory, for example, a spring-ring type, a plug-in type, and a screw type have been generally known. Among them, the spring-ring type clasp has been employed in a largest number of accessories.

Generally, the spring-ring type clasp is formed of a combination of a spring-ring member to be attached to the one end portion of the linear member, and a loop member or a holed plate member to be attached to the other end portion of the linear member. In this case, the spring-ring member includes a partially cut-out ring portion, and a circular-arc movable member slidable within this ring portion. This movable member is formed to be biased by a spring in a direction of closing a cut-out gap. Such a spring-ring type clasp is disclosed, for example, in Japanese Patent Application Laid-open No. 2008-36244.

The plug-in type clasp is formed of a combination of a male member to be attached to the one end portion of the linear member, and a female member to be attached to the other end portion of the linear member. The male member is formed to be locked to the female member, for example, by turning a part of the male member with the male member being plugged in the female member, or by using a biasing force of spring members.

Such a plug-in type clasp is disclosed, for example, in Japanese Patent Application Laid-open No. 10-137016, or Japanese Patent Application Laid-open No. 2012-19946. In addition, the screw type clasp is formed of a combination of a male screw member and a female screw member. By screwing the male screw member into the female screw member, the male screw member and the female screw member can be coupled to each other.

As an example of clasps of other types, there is a buckle type clasp 60 as illustrated in FIG. 5. This buckle type clasp 60 includes a first member 61 that is attached to one end portion of a linear member 65, and a second member 62 that is attached to another end portion of the linear member 65. The first member 61 includes a ring-like first coupling portion 61*a*.

The second member 62 includes a base portion 62*a* that fixes the other end portion of the linear member 65, a flake-like lower plate portion 62*b* that extends straight from the base portion 62*a*, a right-and-left pair of support portions 62*c* that are provided upright at a distal end portion of the lower plate portion 62*b*, and an opening-and-closing portion

62*d* that is pivotally supported by the support portions 62*c*. At a proximal end portion of the opening-and-closing portion 62*d*, a rotary shaft portion 62*e* that is turnably supported by the support portions 62*c* is provided. At a distal end portion of the opening-and-closing portion 62*d*, a curved portion 62*f* curved toward an inside is provided. This curved portion 62*f* of the opening-and-closing portion 62*d* is formed to maintain, at a time when a part of the opening-and-closing portion 62*d* is brought into abutment against the base portion 62*a*, a state of this abutment by being pressed onto an outer peripheral surface of the base portion 62*a* while being slightly deformed.

In such a buckle type clasp 60, in order that the first member 61 and the second member 62 separated from each other are coupled to each other, the opening-and-closing portion 62*d* of the second member 62 is pivoted, and the second member 62 is maintained in an open state. Then, the first coupling portion 61*a* of the first member 61 is moved such that the opening-and-closing portion 62*d* of the second member 62 is passed through an opening portion 61*b* formed through the first coupling portion 61*a*, following which the first coupling portion 61*a* of the first member 61 is held near the support portions 62*c* of the second member 62. Next, the opening-and-closing portion 62*d* of the second member 62 is brought into abutment against the base portion 62*a* by being turned close to the lower plate portion 62*b*. In this way, the first member 61 and the second member 62 are maintained in a coupled state.

SUMMARY

For example, with regard to the spring-ring type clasp, at a time of putting on and taking off the accessory, an operation of the spring-ring member (specifically, operation of moving and holding the small movable member against the biasing force) needs to be performed with one hand. Thus, there is problem that a user often feels difficult and troublesome in performing this operation, that is, operability of the clasp is low. Specifically, in many of cases where the spring-ring type clasp is used in the bracelet or the like, all series of coupling operations and separating operations are performed only with one hand. Thus, difficulties in the operation of the clasp increase, which inconveniences the user. Further, for example, when the linear member of the accessory has a design feature, the spring-ring member and the loop member of the clasp impairs the continuous design feature of the linear member. As a result, an aesthetic appearance of the accessory may be impaired.

In addition, in the spring-ring type clasp, there is no distinction between an outer surface side (front surface side) that is exposed to an outside, and an inner surface side (rear surface side) that faces skin. Thus, for example, in the accessories such as a tennis bracelet, the accessories may be overturned when the clasp is coupled, and may be put on with the front and the rear surfaces of the accessory being oriented in different directions (such as opposite directions). In addition, the user also may wear the accessory without recognizing the overturned state.

When the coupling operation is performed at times of using the plug-in type clasp and the screw type clasp in the bracelet or the like, the locking operation including plugging the male member into the female member while holding the female member, and the operation of screwing the male screw member into the female screw member while holding the female member need to be performed only with one hand. Similar to the spring-ring type clasp, these clasps have the problem of difficulties in their operations. In addition, with regard to these clasps, the locking state of the male member, and the screwed state of the male screw member may be insufficient, and the clasps may be deformed or damaged through use over time. As a result, at the time of putting on the accessory, these clasps may unknowingly and easily separate.

With regard to the buckle type clasp 60 illustrated in FIG. 5, at the time of coupling the first member 61 and the second member 62 to each other, the first coupling portion 61*a* of the first member 61 needs to be moved close to the support portions 62*c* bypassing therethrough an entirety of the long opening-and-closing portion 62*d* including the curved distal-end portion and a protruding piece portion provided to protrude therefrom. Thus, there is a disadvantage that the first coupling portion 61*a* is liable to catch on the long opening-and-closing portion 62*d*. In addition, generally, in many cases, in order to prevent the first member 61 from catching on the opening-and-closing portion 62*d* of the second member 62, the ring-like first coupling portion 61*a* of the first member 61 is increased in size. As a result, it is difficult to downsize the clasp 60 (specifically, first member 61), and an aesthetic appearance of the accessory may be impaired by the clasp 60.

Further, in the coupled state of the clasp 60, the closed state of the second member 62 is maintained by pressing the curved portion 62*f* of the opening-and-closing portion 62*d* onto an outer surface of the base portion 62*a*. Thus, there is a disadvantage that, when the opening-and-closing portion 62*d* is subjected to external force, the opening-and-closing portion 62*d* is liable to open by disengaging from the base portion 62*a*. In addition, as a result of repetition of the opening-and-closing operation of the opening-and-closing portion 62*d*, wear and deformation of the base portion 62*a* and the opening-and-closing portion 62*d* are liable to occur, and pressing strength of the opening-and-closing portion 62*d* decreases. Further, when the opening-and-closing portion 62*d* opens by unknowingly disengaging from the base portion 62*a*, the first member 61 and the second member 62 are subjected to tensile force in directions away from each other by weight of the linear member 65. Thus, the opening-and-closing portion 62*d* opens at up to approximately 180°. As a result, there is another problem that the first member 61 is liable to drop off from the second member 62.

The present invention has been made in view of the above-described related-art problems, and an object thereof is to provide a clasp for an accessory, which enables a coupling operation and a separating operation to be performed easily and smoothly, which is capable of stably maintaining a coupled state, and in addition, which is capable of preventing the accessory from being overturned at a time when the accessory is put on.

In order to achieve the above-mentioned object, according to the present invention, there is provided a clasp for an accessory, the clasp including:

a first clasp member that is arranged at one end portion of a linear member of the accessory;

a second clasp member
- that is arranged at another end portion of the linear member and
- that is capable of being coupled to and separated from the first clasp member, the clasp being primarily characterized in that the first clasp member includes
- a first connecting portion to which the one end portion of the linear member is connected, and
- a first coupling portion
  - that is formed integrally with the first connecting portion and
  - that is coupled to the second clasp member, the first coupling portion includes an insertion hole portion that is provided to allow a part of the second clasp member to be inserted through the insertion hole portion, and the second clasp member includes
- a second connecting portion to which the other end portion of the linear member is connected,
- a second body portion that is formed continuously from and integrally with the second connecting portion,
- a second coupling portion
  - that extends from the second body portion in a direction away from the second connecting portion, and
  - that has a fish-hook shape to be coupled to the first coupling portion,
- an insertion-and-removal opening portion
  - that communicates with an inside space portion of the second coupling portion, and
  - that allows a part of the first coupling portion to pass through the insertion-and-removal opening portion,
- an opening-and-closing portion
  - that is pivotally supported by the second body portion such that the insertion-and-removal opening portion is opened and closed, and
  - that includes an abutment portion
    - which has
      - a substantially L-shape or
      - a substantially circular-arc shape, and
    - which is brought into abutment against an outer peripheral surface of the second coupling portion, and
- a locking portion
  - that locks the opening-and-closing portion when the second coupling portion is brought into abutment against the opening-and-closing portion, and
  - that maintains a state of the abutment.

In the clasp for the accessory according to the present invention, it is preferred that the locking portion include
- a locking recess portion that is provided in a recessed manner in a portion of the outer peripheral surface of the second coupling portion, and
- protruding-portion-to-be-locked
  - that is provided to the abutment portion, and
  - that is inserted into the locking recess portion.

Further, it is preferred that, when the opening-and-closing portion is brought into abutment against the second coupling portion, the second coupling portion and the opening-and-closing portion be inserted through the insertion hole portion of the first clasp member.

Still further, in the clasp for the accessory according to the present invention, it is preferred that, the second clasp member include a protruding piece portion that protrudes from an outer peripheral surface of the abutment portion to an outside, and the protruding piece portion be close to the first clasp member when the abutment portion has been held in abutment against the second coupling portion.

Yet further, in the present invention, it is preferred that the opening-and-closing portion include
- a proximal end portion that is pivotally supported by the second coupling portion, a closure portion
that is arranged between the proximal end portion and the abutment portion, and
that closes the insertion-and-removal opening portion, and
lateral cover portions that are formed integrally with the proximal end portion and the closure portion, and
the lateral cover portions
extend in a manner of jettying to an inside from the proximal end portion and the closure portion in a side view of the second clasp member, and
include restriction rim portions that are formed while being inclined or curved such that a space portion to be formed between the lateral cover portions and a coupling part of the closure portion and the abutment portion forms an angle less than 90°.

Advantageous Effects of Invention

The first clasp member and the second clasp member of the clasp for the accessory according to the present invention are capable of being coupled to each other by being engaged with each other, and capable of being separated from each other.

The first clasp member includes
the first connecting portion to which the one end portion of the linear member is connected, and
the first coupling portion
that is formed integrally with the first connecting portion and
that includes the insertion hole portion.

The second clasp member includes
the second connecting portion to which the other end portion of the linear member is connected,
the second body portion that is formed continuously from and integrally with the second connecting portion,
the second coupling portion
that extends from the second body portion in the direction away from the second connecting portion, and
that has the fish-hook shape,
the insertion-and-removal opening portion
that communicates with the inside space portion of the second coupling portion,
the opening-and-closing portion
that is pivotally supported by the second body portion, and
that includes the abutment portion
which has
the substantially L-shape or
the substantially circular-arc shape, and
which is brought into abutment against the outer peripheral surface of the second coupling portion, and
the locking portion
that locks the opening-and-closing portion by utilizing protrusion-recess engagement or the like when the second coupling portion is brought into abutment against the opening-and-closing portion.

In order to couple the one end portion and the other end portion of the linear member with use of such a clasp of the present invention, first, the clasp is operated to insert the second coupling portion of the second clasp member into the insertion hole portion provided through the first coupling portion of the first clasp member. With this, the first coupling portion of the first clasp member is temporarily held by being hooked to the second coupling portion of the second clasp member. Such an operation of temporarily holding the first clasp member can be smoothly performed only with one hand. Specifically, in the case of the present invention, the first coupling portion of the first clasp member can be temporarily held by the second clasp member by being inserted through a short distal-end part (distal-end post portion) of the second coupling portion formed into the fish-hook shape. Thus, the first coupling portion of the first clasp member is less likely to catch on the second clasp member than, for example, that of the related-art clasp illustrated in FIG. 5. As a result, the operation can be smoothly performed.

Then, the opening-and-closing portion of the second clasp member is pivoted by being pressed toward the second coupling portion that has temporarily held the first clasp member. With this, the abutment portion of the opening-and-closing portion, which has the substantially L-shape or the substantially circular-arc shape, is brought into abutment against the second coupling portion. In addition, the opening-and-closing portion is locked to the second coupling portion or the second body portion with use of the locking portion. In this way, the first clasp member and the second clasp member can be coupled to each other. Such an operation of pivoting and locking the opening-and-closing portion of the second clasp member to the second coupling portion also can be smoothly performed only with one hand.

Meanwhile, in order to separate the one end portion and the other end portion of the linear member from each other with use of the clamp of the present invention, it is only necessary to perform an operation including cancelling the locking state of the opening-and-closing portion of the second clasp member, pivoting the opening-and-closing portion apart from the second coupling portion, and then disengaging the first coupling portion of the first clasp member from the second coupling portion of the second clasp member. Such an operation of separating the clamp also can be smoothly performed only with one hand.

Thus, in the present invention, the coupling operation and the separating operation of the clasp can be easily and smoothly performed only with one hand. In addition, at the time of coupling the first clasp member and the second clasp member of the clasp to each other, the opening-and-closing portion of the second clasp member is locked to the second coupling portion by the locking portion. Thus, the state in which the opening-and-closing portion is held in abutment against the second coupling portion can be maintained. With this, the coupled state of the first clasp member and the second clasp member can be stably maintained.

Further, in the clasp of the present invention, since, as described above, the operation of coupling the first clasp member and the second clasp member to each other includes pivoting the opening-and-closing portion of the second clasp member, orientations of an outer surface side (front surface side) and an inner surface side (rear surface side) of the clasp can be easily checked at the time of the coupling operation, or can be unconsciously grasped. As a result, as in the case of using the related-art spring-ring type clasp, the accessories such as the tennis bracelet can be prevented from being put on in an overturned state. With this, putting on the accessory in a correct orientation can be prompted.

In addition, in the clasp of the present invention, the first clasp member and the second clasp member can be easily downsized as a whole without impairing operability of the clasp. Specifically, in the present invention, as described above, at the time of temporarily holding the first coupling portion of the first clasp member with the second clasp member, it is only necessary to insert the first coupling portion through the short distal-end part of the second coupling portion. Thus, the first coupling portion is prevented from catching on the second clasp member. As a result, the first coupling portion of the first clasp member can be formed, for example, to be smaller (or thinner) than the first coupling portion 61*a* of the related-art clasp 60 illustrated in FIG. 5. Further, the clasp of the present invention can be easily lengthened and shortened along the linear member. Thus, for example, when the linear member of the accessory has a design feature, the clasp of the present invention is adjustable in size of its own in accordance with the design. Thus, the continuous design feature of the linear member can be easily maintained, and the aesthetic appearance of the accessory can be prevented from being impaired.

In such a clasp for the accessory according to the present invention, the locking portion includes the locking recess portion that is provided in the recessed manner in the portion of the outer peripheral surface of the second coupling portion, and the protruding-portion-to-be-locked that is provided to the abutment portion, and that is inserted into the locking recess portion.

With this, the locking portion can be easily provided as a simple structure with respect to the second clasp member. In addition, this locking portion is capable of smoothly locking the opening-and-closing portion to the second coupling portion, and of stably maintaining this locking state. Thus, the clasp can be prevented from unknowingly separating. Further, in this case, a function of maintaining the abutment state of the opening-and-closing portion can be maintained over a time period longer than, for example, that of the related-art clasp 60 illustrated in FIG. 5.

In the present invention, the insertion hole portion of the first clasp member is formed to be capable of allowing both the second coupling portion and the opening-and-closing portion to be inserted therethrough when the opening-and-closing portion of the second clasp member is brought into abutment against the second coupling portion. With this, the first clasp member and the second clasp member can be further securely coupled to each other. Further, when the first clasp member and the second clasp member have been coupled to each other, an orientation of the second clasp member with respect to the first clasp member can be further stabilized. With this, the accessory can be further prevented from being overturned at the time of the coupling operation of the clasp.

In addition, in the present invention, it is preferred that the second clasp member include the protruding piece portion that protrudes from the outer peripheral surface of the abutment portion to the outside, and this protruding piece portion be close to the first clasp member when the abutment portion has been held in abutment against the second coupling portion, and be arranged away from the first clasp member. By providing such a protruding piece portion to the second clasp member, a finger or a nail can be easily hooked to this protruding piece portion. With this, at the time of performing the separating operation of the clasp, the locking state of the opening-and-closing portion of the second clasp member can be easily cancelled. In addition, the opening-and-closing portion can be easily pivoted in a direction apart from the second coupling portion. Thus, the separating operation of the clasp can be further easily and smoothly performed. Further, by arranging the protruding piece portion close to the first clasp member, degradation in feel of the clasp against skin due to the provision of the protruding piece portion can be suppressed.

Further, in the present invention, the opening-and-closing portion includes the proximal end portion that is pivotally supported by the second coupling portion, the closure portion that is arranged between the proximal end portion and the abutment portion, and that closes the insertion-and-removal opening portion from the outside, and the lateral cover portions that are formed integrally with the proximal end portion and the closure portion.

Further, the lateral cover portions of the opening-and-closing portion extend in the manner of jettying to the inside (inner peripheral side) from at least parts of the proximal end portion and the closure portion in the side view of the second clasp member.

Still further, the lateral cover portions of the opening-and-closing portion include the restriction rim portions that are formed while being inclined or curved such that the space portion to be formed between the lateral cover portions and the coupling part at which the closure portion and the abutment portion are coupled straight to each other forms an angle less than 90° in the side view of the second clasp member. Note that, the coupling part of the closure portion and the abutment portion refers to a continuous part (region) including a connection-side end portion of the closure portion, which is connected to the abutment portion, and a connection-side end portion of the abutment portion, which is connected to the closure portion.

By providing such lateral cover portions to the opening-and-closing portion, an appearance of the second clasp member can be enhanced, and quality of an external appearance of the clasp as a whole can be increased. In addition, by these lateral cover portions (specifically, restriction rim portions) of the opening-and-closing portion, movement of the first clasp member relative to the second clasp member (specifically, movement of a coupling shaft portion of the first coupling portion, which is coupled to the second coupling portion) can be advantageously restricted. Thus, the coupled state of the first clasp member and the second clasp member can be further stably maintained. Further, even when the locking by the locking portion of the second clasp member is unknowingly cancelled, the first coupling portion of the first clasp member can be retained within the inside space portion of the second coupling portion by the lateral cover portions of the opening-and-closing portion. Thus, unexpected separation of the clasp can be further advantageously prevented.

DETAILED DESCRIPTION

Below, a preferred embodiment of the present invention is described in detail with reference to the drawings. Note that, the present invention is not limited at all to the embodiment described below. Various modification may be made as long as configurations substantially the same as those of the present invention are provided, and as long as functions and advantages similar to those of the present invention are provided.

Figure 1:
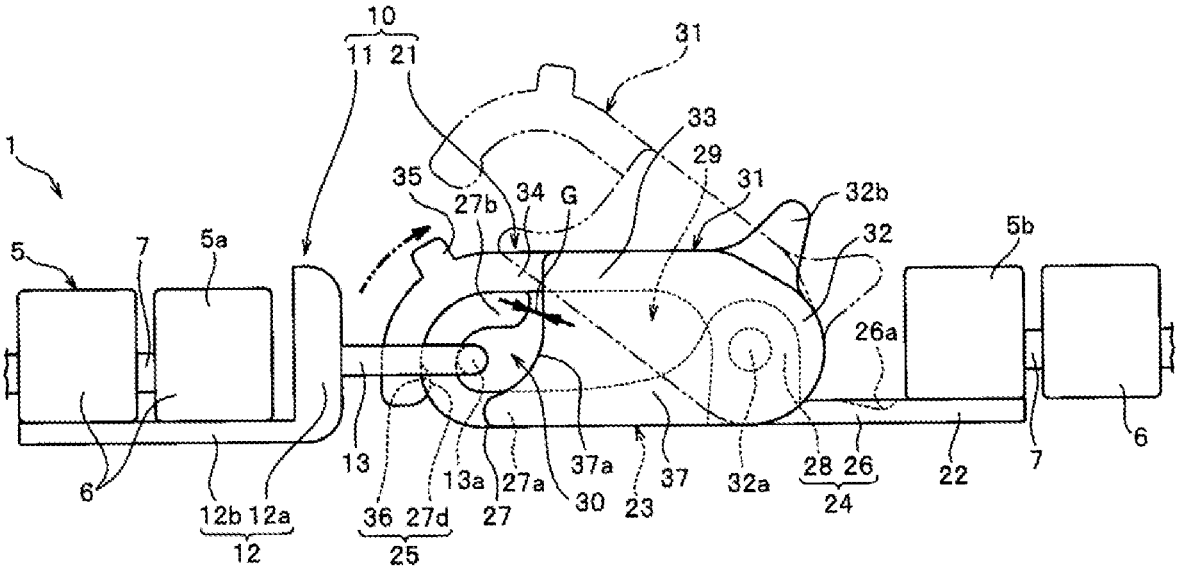
FIG. 1 A side view schematically illustrating a main part of an accessory according to an embodiment of the present invention on an enlarged scale.
Figure 2:
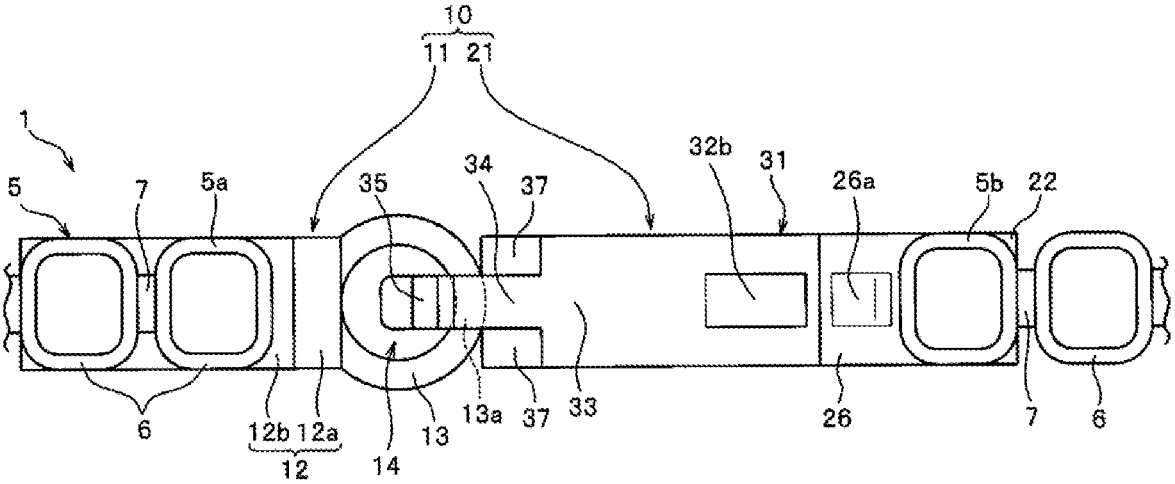
FIG. 2 A schematic plan view of the main part of the accessory illustrated in FIG. 1 as viewed from an outer-peripheral surface (upper surface) side.
Figure 3:
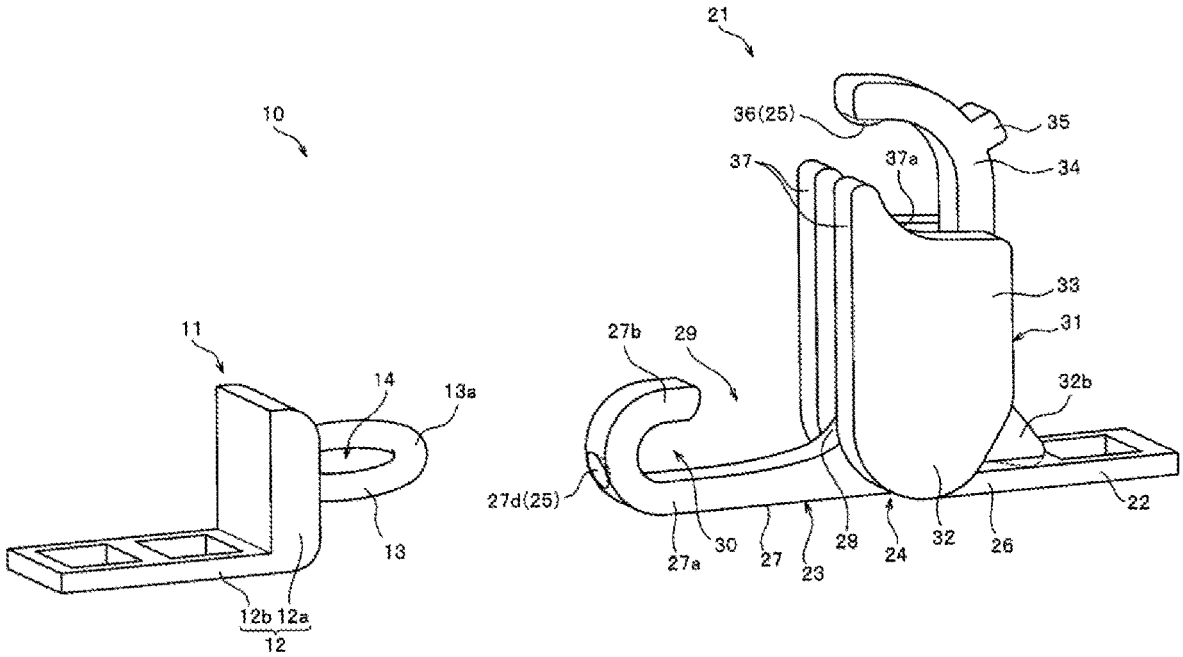
FIG. 3 A perspective view schematically illustrating a state in which a first clasp member and a second clasp member of a clasp provided to the accessory in FIG. 1 are separated from each other.
Figure 4:
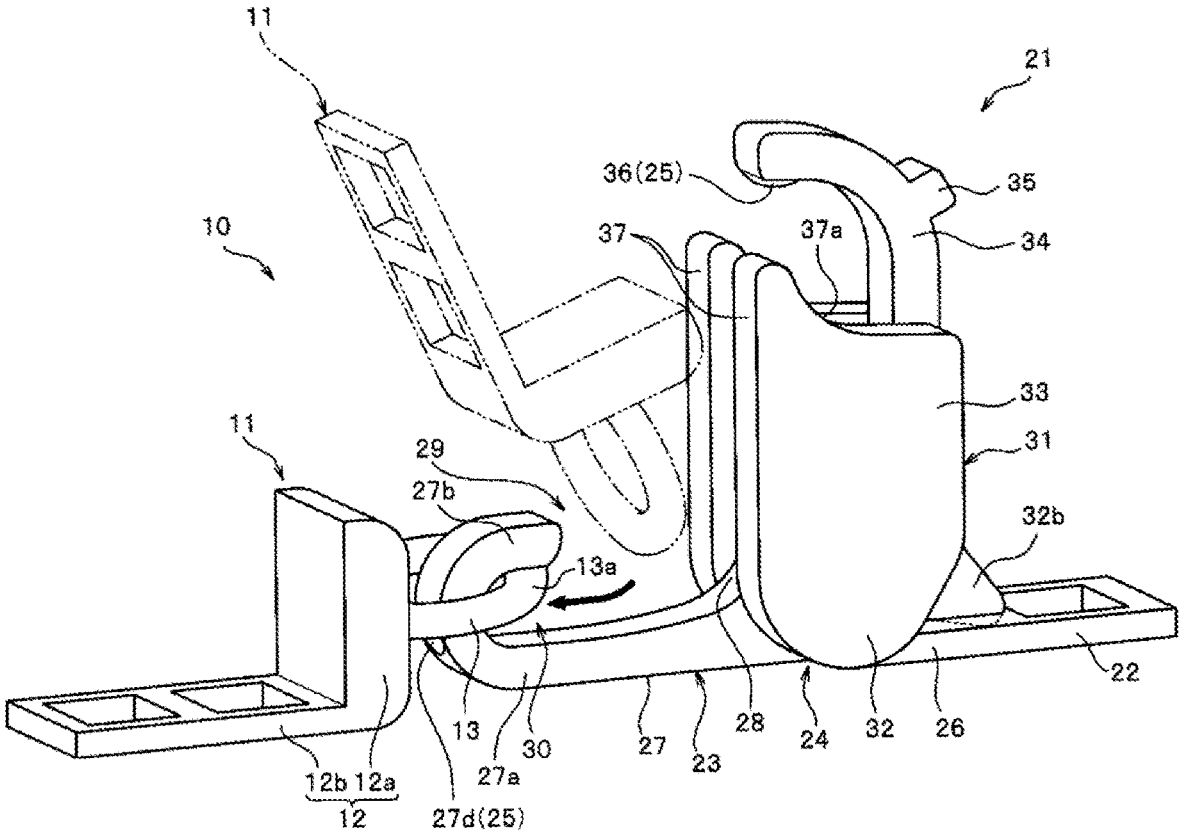
FIG. 4 A perspective view schematically illustrating a state in which the first clasp member illustrated in FIG. 3 is temporarily held by the second clasp member.

FIG. 1 and FIG. 2 are respectively a side view and a plan view schematically illustrating a main part of an accessory according to this embodiment on an enlarged scale. Further, FIG. 3 is a perspective view illustrating a state in which a first clasp member and a second clasp member of a clasp provided to the accessory are separated from each other. FIG. 4 is a perspective view illustrating a state in which the first clasp member is temporarily held by the second clasp member.

Note that, in the following description, a direction of the clasp along a longitudinal direction of a linear member of the accessory (tennis bracelet) is defined as a front-and-rear direction. Specifically, in the case of this embodiment, a right-and-left direction of the drawing sheet of FIG. 1 at a time when reference symbols (numerals) in FIG. 1 are viewed in a correct orientation corresponds to the front-and-rear direction of the clasp. Further, a direction that is orthogonal to the front-and-rear direction of the clasp, and that is oriented to an outer-peripheral surface side (front surface side) exposed to an outside of the clasp, and oriented to an inner-peripheral surface side (rear surface side) facing skin is defined as an upper-and-lower direction. In this embodiment, an upper-and-lower direction of the drawing sheet of FIG. 1 corresponds to the upper-and-lower direction of the clasp. Specifically, in this case, a direction to the outer surface side exposed to the outside of the clasp is defined as an upper side, and a direction to the inner surface side of the clasp, which faces the skin, is defined as a lower side. In addition, a direction orthogonal to both the front-and-rear direction and the upper-and-lower direction of the clasp is defined as a right-and-left direction. In this embodiment, a front-and-back direction of the drawing sheet of FIG. 1 corresponds to the right-and-left direction of the clasp.

A tennis bracelet (line bracelet) 1 of this embodiment is an accessory to be put on a wrist. This tennis bracelet 1 includes an elongated chain-like linear member 5 to be a bracelet body part, and a clasp 10 attached to both end portions of the linear member 5. By coupling the clasp 10, an entirety of the tennis bracelet 1 can be maintained in a ring shape.

The linear member 5 of the tennis bracelet 1 includes a plurality of link portions 6, and connecting portions 7 each of which connects adjacent two of the link portions 6 to each other. The connecting portions 7 are attached to be swingable to the link portions 6. Further, the link portions 6 each include a link body portion that is formed into a substantially quadrangular-cylindrical shape or a substantially cylindrical shape, and a gemstone (diamond) (not shown) to be fixed to an outer surface portion (upper surface portion) of the link body portion. Note that, in the present invention, the linear member 5 is not particularly limited in configuration or structure, and may be arbitrarily changed.

The clasp 10 of the tennis bracelet 1 is made of a metal. This clasp 10 includes a first clasp member 11 that is attached to one end portion 5*a* of the linear member 5, and a second clasp member 21 that is attached to another end portion 5*b* of the linear member 5 and that is capable of being coupled to and separated from the first clasp member 11.

The first clasp member 11 of the clasp 10 includes a first connecting portion 12 to which the one end portion 5*a* of the linear member 5 of the tennis bracelet 1 is fixed and connected, and a first coupling portion 13 that is formed integrally with the first connecting portion 12. The first connecting portion 12 includes a first connecting-body portion 12*a* having a predetermined height dimension (dimension in the upper-and-lower direction), and a first connecting-piece portion 12*b* that extends from the first connecting-body portion 12*a* in a thin plate shape to one side in the front-and-rear direction. In this case, the height dimension of the first connecting-body portion 12*a* is larger than that of the link body portion of each of the link portions 6. Opening window portions each substantially conforming to a shape of an interior space to be provided in the link body portion of each of the link portions 6 are formed in the upper-and-lower direction through the first connecting-piece portion 12*b*.

In the first clasp member 11, the one end portion 5*a* of the linear member 5 is fixed by welding such as brazing to the first connecting-piece portion 12*b* at a position away from the first connecting-body portion 12*a*. Specifically, in this embodiment, two of the link portions 6 of the linear member 5 are fixed to the first connecting-piece portion 12*b* of the first connecting portion 12 such that the first clasp member 11 can be easily picked up with fingers. Note that, in the present invention, the method of connecting the first clasp member 11 to the one end portion 5*a* of the linear member 5 is not particularly limited. For example, the first clasp member 11 and the one end portion 5*a* of the linear member 5 may be connected to each other by bonding with adhesive. Alternatively, the first clasp member 11 and the one end portion 5*a* of the linear member 5 may be connected to each other with a round wire ring. In addition, the first connecting portion 12 of the first clasp member 11 need not necessarily be formed to have a size that allows the two of the link portions 6 to be fixed as described above, and may be formed to have a size that allows one of the link portions 6 or three or more of the link portions 6 to be fixed. Still alternatively, the first clasp member 11 may be formed integrally with the one end portion of the linear member 5.

The first coupling portion 13 extends along the front-and-rear direction from a substantially central portion in the upper-and-lower direction of a surface of the first connecting-body portion 12*a*, which is on a side opposite to that of the first connecting-piece portion 12*b*. An insertion hole portion 14 is provided in the upper-and-lower direction through the first coupling portion 13. The first coupling portion 13 is formed to exhibit, as viewed from above (the outer-peripheral surface side) (refer to FIG. 2), a part of a circular shape or a part of an elliptical shape. A part of this first coupling portion 13, which serves as a coupling post 13*a*, is hooked to and held by a second coupling portion 23 described below of the second clasp member 21 when the first clasp member 11 and the second clasp member 21 have been coupled to each other.

Note that, the first coupling portion 13, which is formed to exhibit a circular shape in cross-section of its coupling post 13*a* in this embodiment, may be formed to exhibit other shapes such as a substantially quadrangular shape in this cross-section in the present invention. Further, the first coupling portion 13 may be formed into a substantially C-shape, a substantially U-shape, or other arbitrary shapes as viewed from above (the outer-peripheral surface side).

The insertion hole portion 14 of the first coupling portion 13 is opened to have a size that allows both the second coupling portion 23 described below of the second clasp member 21 (specifically, a distal-end post portion 27*b* of the second coupling portion 23) and an opening-and-closing portion 31 (specifically, an abutment portion 34 of the opening-and-closing portion 31) to be inserted through when the first clasp member 11 and the second clasp member 21 have been coupled to each other.

Further, in the case of this embodiment, in the opening size of the insertion hole portion 14, in order that the first clasp member 11 coupled to the second clasp member 21 is movable as indicated by an imaginary arrow in FIG. 1, a protruding piece portion 35 described below of the second clasp member 21 can be inserted through the insertion hole portion 14 together with the second coupling portion 23 and the abutment portion 34 of the opening-and-closing portion 31. With this, when the first clasp member 11 and the second clasp member 21 have been coupled to each other, the first coupling portion 13 can be prevented from catching on the second clasp member 21. Specifically, the first coupling portion 13 can be prevented from catching on the protruding piece portion 35. With this, the opening-and-closing portion 31 described below of the second clasp member 21 can be prevented from being pivoted in a direction in which the opening-and-closing portion 31 is opened.

The second clasp member 21 includes a second connecting portion 22 to which the other end portion 5*b* of the linear member 5 of the tennis bracelet 1 is fixed and connected, a second body portion 24 that is formed continuously from and integrally with the second connecting portion 22, the second coupling portion 23 that extends from the second body portion 24 in a direction away from the second connecting portion 22 (direction toward the first clasp member 11), and that has a fish-hook shape, the opening-and-closing portion 31 that is pivotally arranged in the second body portion 24, and a locking portion 25 that maintains a state in which the opening-and-closing portion 31 is held in abutment against the second coupling portion 23. Specifically, in the second clasp member 21 of this embodiment, the second body portion 24 that pivotally supports the opening-and-closing portion 31 is provided on a side closer to the other end portion 5*b* of the linear member 5 (side away from the first clasp member 11) than to a distal end portion of the second coupling portion 23, which is initially inserted into the insertion hole portion 14 of the first clasp member 11.

In this case, the second connecting portion 22 is formed into a rectangular frame-like thin plate piece having an opening window portion substantially at its center. The other end portion 5*b* of the linear member 5 is fixed by welding such as brazing to the second connecting portion 22. Note that, in the present invention, the method of connecting the second clasp member 21 to the other end portion 5*b* of the linear member 5 is not particularly limited as well as that for the above-described first clasp member 11.

The second body portion 24 includes a body base portion 26 that is continuous with the second connecting portion 22, and that restricts a pivotal range of the opening-and-closing portion 31 by allowing a part of the opening-and-closing portion 31 to be held in abutment against the body base portion 26, and a support portion 28 that is formed integrally with the body base portion 26, and that supports the opening-and-closing portion 31. The body base portion 26 has a dimension in the right-and-left direction (width dimension), which is the same as that of the second connecting portion 22.

In the case of this embodiment, in a central portion in a width direction (right-and-left direction) of the body base portion 26, a housing recess portion 26*a* capable of housing the part of the opening-and-closing portion 31 that turns in an opening direction by allowing this part to be held in abutment against the housing recess portion 26*a* such that the pivotal range of the opening-and-closing portion 31 is approximately 90° is formed correspondingly to a position of a tail portion 32*b* described below of the opening-and-closing portion 31. Herein, the pivotal range of the opening-and-closing portion 31 refers to a range in which the opening-and-closing portion 31 (specifically, tail portion 32*b*), which has been locked by the locking portion 25 as illustrated in FIG. 1, pivots to enter a state in which the opening-and-closing portion 31 is held in abutment against the body base portion 26 as illustrated in FIG. 3 and FIG. 4.

The support portion 28 of the second body portion 24 is formed to have a smaller dimension in the right-and-left direction than that of the body base portion 26, and to protrude in a thin plate shape from the body base portion 26. In this support portion 28, bearing recess portions into which a rotary shaft portion 32*a* described below of the opening-and-closing portion 31 is inserted are formed. By engaging these bearing recess portions of the support portion 28 and the rotary shaft portion 32*a* of the opening-and-closing portion 31 with each other, the opening-and-closing portion 31 is pivotally supported by the second body portion 24.

The second coupling portion 23 is formed of a fish-hook-like coupling body portion 27 that extends from the support portion 28 of the second body portion 24 in a direction on a side opposite to that of the second connecting portion 22. Between a distal end portion of the coupling body portion 27 and the support portion 28, an insertion-and-removal opening portion 29 that is opened to allow the coupling post 13*a* of the first coupling portion 13 to pass therethrough is formed.

The coupling body portion 27 is formed to have, in the right-and-left direction, a smaller dimension than that of the second connecting portion 22, and the same size as that of the support portion 28. This coupling body portion 27 includes a trunk post portion 27*a* that extends substantially straight from the second body portion 24 along the front-and-rear direction, and the distal-end post portion 27*b* that extends from the trunk post portion 27*a* via a curved portion (bent portion). In the side view of the second clasp member 21, the distal-end post portion 27*b* extends in a circular-arc shape from the curved portion in a curved manner toward an upper end portion of the support portion 28.

Between the trunk post portion 27*a* and the distal-end post portion 27*b* of the coupling body portion 27, an inside space portion 30 capable of housing the part (coupling post 13*a*) of the first coupling portion 13 is formed in communication with the insertion-and-removal opening portion 29. Further, in a portion of an outer peripheral surface of a proximal end portion (end portion on a side close to the curved portion) of the distal-end post portion 27*b*, a locking recess portion 27*d* that locks and makes the opening-and-closing portion 31 immovable by allowing a part of the opening-and-closing portion 31 (protruding-portion-to-be-locked 36 described below of the opening-and-closing portion 31) to fit thereto is provided in a recessed manner along the right-and-left direction. In this case, the locking recess portion 27*d* is formed into a shape of a recessed surface that is recessed deepest at its central portion.

A dimension of a length of the distal-end post portion 27*b* formed into the circular-arc shape is set such that a central angle of the circular arc is 135° or more, or preferably, 180° or more. Further, the length that this distal-end post portion 27*b* is formed to have does not reach positions of lateral cover portions 37 described below of the opening-and-closing portion 31 such that, as the clasp 10 is viewed from the right-and-left lateral sides (refer to FIG. 1) under the state in which the abutment portion 34 of the opening-and-closing portion 31 is held in abutment against the second coupling portion 23, the distal-end post portion 27*b* does not hide in the lateral cover portions 37, and that a gap G is formed between the distal-end post portion 27*b* and restriction rim portions 37*a* described below of the lateral cover portions 37. In addition, in this case, the length of the distal-end post portion 27*b* is set such that the gap G has a minimum value at which the coupling post 13*a* of the first coupling portion 13 is not allowed to be inserted therethrough in the state illustrated in FIG. 1. In other words, the gap G is formed to be smaller than a thickness of the coupling post 13*a* of the first coupling portion 13 (specifically, diameter in circular cross-section of the coupling post 13*a*).

The opening-and-closing portion 31 of the second clasp member 21 includes a proximal end portion 32 including the rotary shaft portion 32*a* that is pivoted about the bearing recess portions provided in the support portion 28 of the second body portion 24, a closure portion 33 that extends from the proximal end portion 32, the abutment portion 34 that is formed into a substantially circular-arc shape and further extends from the closure portion 33, the protruding piece portion 35 that protrudes from a curved part of the abutment portion 34 to an outside, the protruding-portion-to-be-locked 36 that is formed at a distal end portion of the abutment portion 34 and inserted into the locking recess portion 27*d* of the second coupling portion 23, and the lateral cover portions 37 that have a thin plate shape and extend, under the state in which the abutment portion 34 is held in abutment, from the proximal end portion 32 and the closure portion 33 to positions on the right-and-left lateral side of the trunk post portion 27*a* of the second coupling portion 23.

This proximal end portion 32 of the opening-and-closing portion 31 includes a housing portion (housing space portion) that houses the support portion 28 of the second body portion 24, the rotary shaft portion 32*a* that protrudes in the right-and-left direction toward the housing portion, and the tail portion 32*b* that stops the opening-and-closing portion 31 from turning by abutting against a bottom surface of the above-described housing recess portion 26*a* provided in the second body portion 24. In this case, the tail portion 32*b* is arranged at an upper end portion of the proximal end portion 32, and has a tongue shape jettying obliquely upward in the side view of the second clasp member 21. By providing such a tail portion 32*b* to the opening-and-closing portion 31, at a time of, for example, turning the opening-and-closing portion 31 in the opening direction, the tail portion 32*b* can be easily pushed by a finger or the like. With this, an operation of turning the opening-and-closing portion 31 can be facilitated.

The closure portion 33 of the opening-and-closing portion 31, which extends substantially straight from the proximal end portion 32, is formed to close the insertion-and-removal opening portion 29 of the second clasp member 21 from above cooperatively with a part of the proximal end portion 32 when the abutment portion 34 is brought into abutment against the second coupling portion 23. The abutment portion 34 of this embodiment is formed in the substantially circular-arc shape from the closure portion 33 so as to be capable of being held in abutment against, or preferably, held in surface contact with at least a part of the outer peripheral surface of the distal-end post portion 27*b* of the second coupling portion 23. Note that, in the present invention, when, for example, the second coupling portion 23 has a different shape, the abutment portion 34 may be formed to extend in a substantially L-shape from the closure portion 33 in conformity with this shape of the second coupling portion 23.

The protruding piece portion 35 protrudes obliquely upward to the outside from a curving-start part of the above-mentioned curved portion of the abutment portion 34. In this case, as illustrated in FIG. 1, under the state in which the first clasp member 11 and the second clasp member 21 are coupled to each other, and at the same time, under the state in which the abutment portion 34 of the second clasp member 21 is held in abutment against the second coupling portion 23, the protruding piece portion 35 is arranged at a position relatively close to the first connecting-body portion 12*a* of the first clasp member 11. In particular, in the case of this embodiment, in the side view of the second clasp member 21, in the front-and-rear direction, the abutment portion 34 is arranged on a side closer to the first clasp member 11 (side away from the second connecting portion 22) than to a position of the distal end of the distal-end post portion 27*b* having the substantially circular-arc shape. With this, degradation in feel of the clasp 10 against the skin due to the provision of the protruding piece portion 35 can be suppressed. In addition, the protruding piece portion 35 is formed away from the first connecting-body portion 12*a* such that, when the first clasp member 11 and the second clasp member 21 are held substantially straight in the side view, a gap is formed between the protruding piece portion 35 of the second clasp member 21 and the first connecting-body portion 12*a*.

Further, the protruding piece portion 35 is formed to be relatively short so as to be capable of being inserted through the insertion hole portion 14 provided to the first clasp member 11 together with the second coupling portion 23 and with the abutment portion 34 of the opening-and-closing portion 31. Specifically, in the case of this embodiment, in the side view of the second clasp member 21, the protruding piece portion 35 is formed such that a protruding length of the protruding piece portion 35 from the abutment portion 34 is substantially the same as a thickness of the abutment portion 34 (interval between its inner peripheral surface and its outer peripheral surface), and is smaller than the thickness of the abutment portion 34.

At the distal end portion of the abutment portion 34, the protruding-portion-to-be-locked 36 that swells toward the inner peripheral side of the abutment portion 34 having the substantially circular-arc shape (or substantially L-shape) is formed to have such a size as to be capable of being inserted into the locking recess portion 27*d* of the second coupling portion 23. This protruding-portion-to-be-locked 36 provided to the opening-and-closing portion 31, and the locking recess portion 27*d* provided in the second coupling portion 23 constitute the locking portion 25 that allows the opening-and-closing portion 31 to be locked to the second coupling portion 23 when the abutment portion 34 is brought into abutment against the second coupling portion 23, and that maintains this abutment state. Note that, in the present invention, the locking portion that is provided to maintain the abutment state of the abutment portion 34 is not particularly limited in configuration, and may be formed into other configurations as long as the abutment state of the abutment portion 34 can be maintained. Specifically, as the locking portion, recess portions and protruding portions to be engaged with each other may be formed with respect to the lateral cover portions 37 and the trunk post portion 27*a* of the second coupling portion 23.

In this case, the protruding-portion-to-be-locked 36 provided to the opening-and-closing portion 31 is formed to swell into a spherical shape in a direction orthogonal to the pivotal direction of the opening-and-closing portion 31 (that is, direction orthogonal to the distal end portion of the abutment portion 34 having the substantially circular-arc shape). In other words, in the side view of the second clasp member 21, the swelling surface of the protruding-portion-to-be-locked 36 is formed into a circular-arc shape. In addition, in the side view of the second clasp member 21, the protruding-portion-to-be-locked 36 of this embodiment is provided integrally with the distal end portion of the abutment portion 34 in a manner that the swelling curved surface of the protruding-portion-to-be-locked 36 forms a curved surface that is smoothly continuous with a distal end surface of the abutment portion 34. With this, the protruding-portion-to-be-locked 36 of the abutment portion 34 can be smoothly inserted into and removed from the locking recess portion 27*d*.

The opening-and-closing portion 31 of this embodiment includes the right-and-left pair of lateral cover portions 37 as described above. The lateral cover portions 37 are formed to jetty to the inside from the proximal end portion 32 and the closure portion 33 so as to cover, from the lateral sides, a part of the inside space portion 30 to be formed in the second coupling portion 23 and the insertion-and-removal opening portion 29 when the opening-and-closing portion 31 is closed with respect to the second coupling portion 23 (that is, when the abutment portion 34 of the opening-and-closing portion 31 is brought into abutment against the second coupling portion 23). In this case, the lateral cover portions 37 are formed to have such a size that, when the opening-and-closing portion 31 is closed, the lateral cover portions 37 overlap with at least a part of the trunk post portion 27*a* of the second coupling portion 23 in the side view of the second clasp member 21. Specifically, in the case of this embodiment, in the size that the lateral cover portions 37 are formed to have, lower edges of the lateral cover portions 37 and a lower edge of the trunk post portion 27*a* of the second coupling portion 23 overlap with each other. With this, an appearance of the second clasp member 21 can be enhanced, and quality of an external appearance of the clasp 10 itself can be increased.

Further, the lateral cover portions 37 include the restriction rim portions 37*a* that extend while being obliquely curved (or inclined) from the closure portion 33 such that, when the opening-and-closing portion 31 is closed, a space portion to be formed between the lateral cover portions 37 and a coupling part of the closure portion 33 and the abutment portion 34 forms an angle less than 90° in the side view of the second clasp member 21. Specifically, in this embodiment, the lateral cover portions 37 are formed to have such a size with respect to the distal-end post portion 27*b* of the second coupling portion 23 that, as described above, the gap G to be formed between the distal-end post portion 27*b* and the restriction rim portions 37*a* has the minimum value at which the coupling post 13*a* of the first coupling portion 13 is not allowed to be inserted therethrough in the state illustrated in FIG. 1.

In the tennis bracelet 1 including the clasp 10 as described above of this embodiment, under the state in which the first clasp member 11 connected to the one end portion 5*a* of the linear member 5 and the second clasp member 21 connected to the other end portion 5*b* of the linear member 5 are separated from each other, in order to couple the first clasp member 11 and the second clasp member to each other, first, as illustrated in FIG. 3, the insertion-and-removal opening portion 29 of the second clasp member 21 is opened by pivoting the opening-and-closing portion 31 of the second clasp member 21 apart from the coupling body portion 27 of the second coupling portion 23. This operation of pivoting the opening-and-closing portion 31 of the second clasp member 21 can be easily performed with one hand. Note that, this operation of pivoting the opening-and-closing portion 31 may be performed with both hands.

Then, the first clasp member 11 is brought close to the second clasp member 21 held, for example, on the wrist. Next, as indicated by imaginary lines in FIG. 4, the coupling post 13*a* of the first coupling portion 13 of the first clasp member 11 is inserted into the opened insertion-and-removal opening portion 29 of the second clasp member 21. After that, while the distal-end post portion 27*b* of the second coupling portion 23 is inserted through the insertion hole portion 14 provided through the first coupling portion 13 of the first clasp member 11, the coupling post 13*a* of the first coupling portion 13 is moved from the insertion-and-removal opening portion 29 into the inside space portion 30 surrounded by the trunk post portion 27*a* and the distal-end post portion 27*b* of the second coupling portion 23. More preferably, the coupling post 13*a* of the first coupling portion 13 is brought into contact with the proximal end portion of the distal-end post portion 27*b* of the second coupling portion 23.

In this way, the first clasp member 11 can be temporarily held by being hooked to the second clasp member 21. Such an operation of temporarily holding the first clasp member 11 also can be easily performed with one hand. Further, in the case of this embodiment, since the first coupling portion 13 of the first clasp member 11 is formed to exhibit the part of the circular shape (part of the elliptical shape) in the plan view as described above, even when the first clasp member 11 assumes, for example, a posture obliquely inclined with respect to the front-and-rear direction, the operation of inserting the first clasp member 11 into the insertion-and-removal opening portion 29 of the second clasp member 21 and temporarily holding the first clasp member 11 with the second coupling portion 23 can be easily and smoothly performed.

Figure 5:
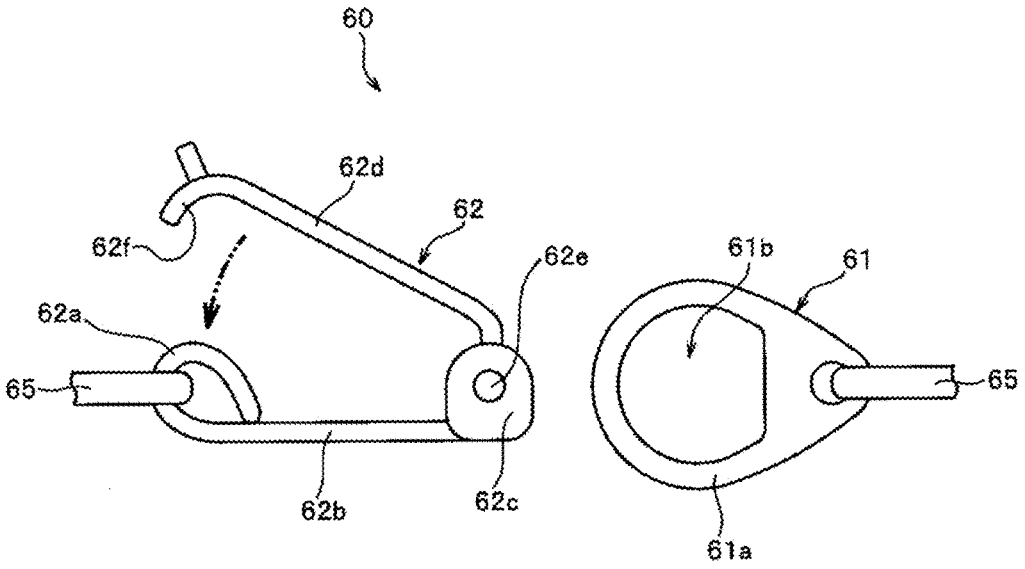
FIG. 5 (prior art)
FIG. 5 A side view illustrating a related-art clasp.

Further, in this embodiment, the distal-end post portion 27*b* of the second coupling portion 23, which needs to be inserted through the insertion hole portion 14 of the first coupling portion 13 at the time of temporarily holding the first clasp member 11, is short. Thus, for example, unlike the related-art clasp 60 illustrated in FIG. 5, it is unnecessary to insert the entirety of the long opening-and-closing portion 62*d*. In addition, in the case of this embodiment, the distal-end post portion 27*b* of the second coupling portion 23 is formed to have substantially a uniform thickness as a whole. Thus, at the time when the distal-end post portion 27*b* of the second coupling portion 23 is inserted through the insertion hole portion 14 of the first coupling portion 13, the first coupling portion 13 of the first clasp member 11 is prevented from catching on the distal-end post portion 27*b*. Thus, even by the operation with one hand, the first clasp member 11 can smoothly be temporarily held by the second clasp member 21.

Further, by temporarily holding the first clasp member 11 with the second clasp member 21 as illustrated in FIG. 4, the first clasp member 11 is prevented from disengaging from the second clasp member 21 even after the first clasp member 11 is released from the fingers. In addition, weight of the linear member 5 causes the first clasp member 11 and the second clasp member 21 to be pulled in directions away from each other, and hence the state in which the first clasp member 11 is temporarily held can be easily and stably maintained.

After the first clasp member 11 is temporarily held, the opening-and-closing portion 31 of the second clasp member 21 is pivoted close to the second coupling portion 23 (coupling body portion 27). With this, the circular-arc abutment portion 34 of the opening-and-closing portion 31 is brought into abutment against the second coupling portion 23. The operation of pivoting the opening-and-closing portion 31 of the second clasp member 21 in this way also can be easily performed with one hand.

By bringing the abutment portion 34 into abutment against the second coupling portion 23 as described above, the closure portion of the opening-and-closing portion 31 closes the insertion-and-removal opening portion 29 of the second clasp member 21 from above. At the same time, the lateral cover portions 37 of the opening-and-closing portion 31 cover the inside space portion 30 of the second coupling portion 23 from the right-and-left lateral sides. With this, a movable region of the coupling post 13*a* of the first clasp member 11 within the inside space portion 30 can be restricted (narrowed down). In this way, the first clasp member 11 and the second clasp member 21 can be coupled to each other as illustrated in FIG. 1, and the tennis bracelet 1 can be maintained in a ring shape.

Further, at this time, by bringing the abutment portion 34 of the opening-and-closing portion 31 of the second clasp member 21 into abutment against the second coupling portion 23, the abutment portion 34 can be inserted from above through the insertion hole portion 14 formed in the first coupling portion 13 of the first clasp member 11. In addition, the protruding-portion-to-be-locked 36 provided at the distal end portion of the opening-and-closing portion 31 can be inserted into and locked to the locking recess portion 27*d* provided in the second coupling portion 23.

In this way, not only the distal-end post portion 27*b* of the second coupling portion 23 but also the abutment portion 34 of the opening-and-closing portion 31 can be inserted through the insertion hole portion 14 of the first clasp member 11. With this, the first clasp member 11 and the second clasp member 21 can be further securely coupled to each other. In addition, the protruding-portion-to-be-locked 36 provided to the opening-and-closing portion 31 is locked to the second coupling portion 23. With this, the state in which the abutment portion 34 of the opening-and-closing portion 31 is held in abutment against the second coupling portion 23 can be maintained, and the coupled state of the first clasp member 11 and the second clasp member 21 can be stably maintained.

Further, by performing the operation of coupling the first clasp member 11 and the second clasp member 21 to each other as in this embodiment, which includes pivoting the opening-and-closing portion 31 of the second clasp member 21, orientations of an upper surface side (front surface side) and a lower surface side (rear surface side) of the clasp 10 can be easily checked at the time of the coupling operation, or can be unconsciously grasped. As a result, the tennis bracelet 1 can be prevented from being put on in an overturned state. With this, putting on the accessory in a correct orientation can be prompted.

Further, when the first clasp member 11 and the second clasp member 21 have been coupled to each other as illustrated in FIG. 1, the right-and-left lateral cover portions 37 provided to the second clasp member 21 (specifically, the above-described oblique restriction rim portions 37*a* provided to the lateral cover portions 37) enable proper restriction of the movable range of the coupling post 13*a* of the first clasp member 11 within the inside space portion 30 of the second clasp member 21. In addition, as described above, the gap G to be formed between the distal-end post portion 27*b* of the second clasp member 21 and the restriction rim portions 37*a* is formed to have the size that does not allow the coupling post 13*a* of the first coupling portion 13 to be inserted therethrough. With this, the coupling post 13*a* of the first clasp member 11 can be stably retained within the inside space portion 30 of the second clasp member 21. Further, in the case of this embodiment, by the weight of the linear member 5, force in the directions away from each other is applied to the first clasp member 11 and the second clasp member 21 coupled to each other. Thus, a structural advantage that the state in which the coupling post 13*a* of the first clasp member 11 is held in abutment against the distal-end post portion 27*b* of the second coupling portion 23 is easily maintained is also obtained.

As a result, for example, occurrence of a risk that the coupling post 13*a* of the first clasp member 11 accidentally pushes and causes the opening-and-closing portion 31 of the second clasp member 21 to pivot in the opening direction can be advantageously prevented. Thus, the coupled state of the first clasp member 11 and the second clasp member 21 can be further securely maintained. With this, the first clasp member 11 and the second clasp member 21 are prevented from unknowingly disengaging from each other.

Further, even in a case where unexpected external force is applied to the opening-and-closing portion 31, and the opening-and-closing portion 31 is turned thereby, for example, to a position as indicated by imaginary lines in FIG. 1, the opening-and-closing portion 31 does not open any further even by being pulled by the linear member 5. In addition, the second clasp member 21 of this embodiment includes the right-and-left pair of lateral cover portions 37 as described above. Thus, these lateral cover portions 37 close the insertion-and-removal opening portion 29 of the second clasp member 21 so as to suppress the coupling post 13*a* of the first clasp member 11 from popping out of the inside space portion 30. With this, the clasp 10 can be prevented from being disengaged.

Meanwhile, under the state in which the first clasp member 11 and the second clasp member 21 are coupled to each other as illustrated in FIG. 1, in order to separate the first clasp member 11 and the second clasp member 21 from each other, first, a finger or a nail is hooked to the protruding piece portion 35 of the second clasp member 21. With this, the opening-and-closing portion 31 of the second clasp member 21 is pivoted apart from the second coupling portion 23. In this way, the insertion-and-removal opening portion 29 of the second clasp member 21 is opened. This operation of pivoting the opening-and-closing portion 31 can be easily performed with one hand.

Then, the first clasp member 11 is held with fingers, and the coupling post 13*a* of the first clasp member 11 is removed from the inside space portion 30 of the second clasp member 21 through the insertion-and-removal opening portion 29. With this, the first coupling portion 13 of the first clasp member 11 is disengaged from the second coupling portion 23 of the second clasp member 21. In this way, the first clasp member 11 and the second clasp member 21 can be easily and smoothly separated from each other only with one hand.

According to the clasp 10 as described above in this embodiment, both the coupling operation and the separating operation of the first clasp member 11 and the second clasp member 21 can be easily and smoothly performed only with one hand. Thus, operability of the clasp 10 of this embodiment can be increased significantly higher than that of, for example, the related-art spring-ring type clasp or the related-art plug-in type clasp. Thus, even persons who are not good at handling the related-art clasps can effortlessly perform the coupling operation and the separating operation of the clasp 10 of this embodiment with respect to the accessories such as the tennis bracelet 1 that uses the clasp 10 of this embodiment. As a result, they can use the accessories further handily and conveniently.

In addition, the clasp 10 of this embodiment is formed of a simple structure that can be easily subjected, for example, to molding processes, and hence is applicable not only to bracelets such as the tennis bracelet 1, but also similar to accessories such as a necklace, a pendant, and an anklet. Specifically, in the present invention, the first clasp member 11 and the second clasp member 21 of the clasp 10 can be easily downsized, or can be easily lengthened or shortened along the linear member 5. With this, a range of options of the clasp 10 that can be employed in the accessories can be significantly expanded. As a result, design and beauty of the accessories can be further advantageously expressed.

The invention claimed is:

1. A clasp for an accessory, the clasp comprising:
- a first clasp member that is arranged at one end portion of a linear member of the accessory;
- a second clasp member
  - that is arranged at another end portion of the linear member and
  - that is capable of being coupled to and separated from the first clasp member, the clasp further comprising:
- the first clasp member includes
  - a first connecting portion to which the one end portion of the linear member is connected, and
  - a first coupling portion
    - that is formed integrally with the first connecting portion and
    - that is coupled to the second clasp member,
- the first coupling portion includes an insertion hole portion that is provided to allow a part of the second clasp member to be inserted through the insertion hole portion, and
- the second clasp member includes
  - a second connecting portion to which the other end portion of the linear member is connected,
  - a second body portion that is formed continuously from and integrally with the second connecting portion,
  - a second coupling portion
    - that extends from the second body portion in a direction away from the second connecting portion, and
    - that has a fish-hook shape to be coupled to the first coupling portion, an insertion-and-removal opening portion
    - that communicates with an inside space portion of the second coupling portion, and
    - that allows a part of the first coupling portion to pass through the insertion-and-removal opening portion,
  - an opening-and-closing portion
    - that is pivotally supported by the second body portion such that the insertion-and-removal opening portion is opened and closed, and
    - that includes an abutment portion
      - which has
        - a substantially L-shape or
        - a substantially circular-arc shape, and
      - which is brought into abutment against an outer peripheral surface of the second coupling portion,
  - a locking portion
    - that locks the opening-and-closing portion when the second coupling portion is brought into abutment against the opening-and-closing portion, and
    - that maintains a state of the abutment, and
  - a protruding piece portion
    - that protrudes from an outer peripheral surface of the abutment portion to an outside,
    - that is closer to the first clasp member than to the second connecting portion when the abutment portion has been held in abutment against the second coupling portion, and
    - that overlaps the first clasp member when the abutment portion has been held in abutment against the second coupling portion.

2. The clasp for the accessory according to claim 1, wherein
- the locking portion includes a locking recess portion that is provided in a recessed manner in a portion of the outer peripheral surface of the second coupling portion, and a protruding-portion-to-be-locked
  - that is provided to the abutment portion, and
  - that is inserted into the locking recess portion.

3. The clasp for the accessory according to claim 1, wherein,
- when the opening-and-closing portion is brought into abutment against the second coupling portion, the second coupling portion and the opening-and-closing portion are inserted through the insertion hole portion of the first clasp member.

4. The clasp for the accessory according to claim 1, wherein
- the opening-and-closing portion includes
  - a proximal end portion that is pivotally supported by the second coupling portion,
  - a closure portion
    - that is arranged between the proximal end portion and the abutment portion, and
    - that closes the insertion-and-removal opening portion, and
  - lateral cover portions that are formed integrally with the proximal end portion and the closure portion, and
- the lateral cover portions
  - extend in a manner of jettying to an inside from at least parts of the proximal end portion and the closure portion in a side view of the second clasp member, and
  - include restriction rim portions that are formed while being inclined or curved such that a space portion to be formed between the lateral cover portions and a coupling part of the closure portion and the abutment portion forms an angle less than 90°.

5. The clasp for the accessory according to claim 4, wherein a gap is formed between a distal-end post portion of the second coupling portion and the restriction rim portions, the gap being smaller than a thickness of the first coupling portion.

6. The clasp for the accessory according to claim 1, wherein the opening-and-closing portion includes a proximal end portion that is pivotally supported by the second coupling portion, and a tail portion arranged at an upper end portion of the proximal end portion and has a tongue shape jettying obliquely upward.

7. The clasp for the accessory according to claim 6, wherein the second body portion includes a housing recess portion within which the tail portion is receivable.

8. A clasp for an accessory, the clasp comprising:

a first clasp member that is arranged at one end portion of a linear member of the accessory;

a second clasp member that is arranged at another end portion of the linear member and that is capable of being coupled to and separated from the first clasp member, the clasp further comprising:

the first clasp member includes a first connecting portion to which the one end portion of the linear member is connected, and a first coupling portion that is formed integrally with the first connecting portion and that is coupled to the second clasp member, the first coupling portion includes an insertion hole portion that is provided to allow a part of the second clasp member to be inserted through the insertion hole portion, and the second clasp member includes a second connecting portion to which the other end portion of the linear member is connected, a second body portion that is formed continuously from and integrally with the second connecting portion, a second coupling portion that extends from the second body portion in a direction away from the second connecting portion, and that has a fish-hook shape to be coupled to the first coupling portion, an insertion-and-removal opening portion that communicates with an inside space portion of the second coupling portion, and that allows a part of the first coupling portion to pass through the insertion-and-removal opening portion, an opening-and-closing portion that is pivotally supported by the second body portion such that the insertion-and-removal opening portion is opened and closed, and that includes an abutment portion which has a substantially L-shape or a substantially circular-arc shape, and which is brought into abutment against an outer peripheral surface of the second coupling portion, a proximal end portion that is pivotally supported by the second coupling portion, and a tail portion arranged at an upper end portion of the proximal end portion and has a tongue shape jettying obliquely upward, a protruding piece portion that protrudes from an outer peripheral surface of the abutment portion to an outside, that is closer to the first clasp member than to the second connecting portion when the abutment portion has been held in abutment against the second coupling portion, and a locking portion that locks the opening-and-closing portion when the second coupling portion is brought into abutment against the opening-and-closing portion, and that maintains a state of the abutment.

9. The clasp for the accessory according to claim 8, wherein the locking portion includes a locking recess portion that is provided in a recessed manner in a portion of the outer peripheral surface of the second coupling portion, and a protruding-portion-to-be-locked that is provided to the abutment portion, and that is inserted into the locking recess portion.

10. The clasp for the accessory according to claim 8, wherein, when the opening-and-closing portion is brought into abutment against the second coupling portion, the second coupling portion and the opening-and-closing portion are inserted through the insertion hole portion of the first clasp member.

11. The clasp for the accessory according to claim 8, wherein the opening-and-closing portion includes a closure portion that is arranged between the proximal end portion and the abutment portion, and that closes the insertion-and-removal opening portion, and lateral cover portions that are formed integrally with the proximal end portion and the closure portion, and the lateral cover portions extend in a manner of jettying to an inside from at least parts of the proximal end portion and the closure portion in a side view of the second clasp member, and include restriction rim portions that are formed while being inclined or curved such that a space portion to be formed between the lateral cover portions and a coupling part of the closure portion and the abutment portion forms an angle less than 90°.

12. The clasp for the accessory according to claim 8, wherein the protruding piece portion overlaps the first clasp member when the abutment portion has been held in abutment against the second coupling portion.

13. The clasp for the accessory according to claim 8, wherein the second body portion includes a housing recess portion within which the tail portion is receivable.

14. A clasp for an accessory, the clasp comprising:

a first clasp member that is arranged at one end portion of a linear member of the accessory;

a second clasp member that is arranged at another end portion of the linear member and that is capable of being coupled to and separated from the first clasp member, the clasp further comprising:

the first clasp member includes a first connecting portion to which the one end portion of the linear member is connected, and a first coupling portion
that is formed integrally with the first connecting portion and
that is coupled to the second clasp member, the first coupling portion includes an insertion hole portion that is provided to allow a part of the second clasp member to be inserted through the insertion hole portion, and the second clasp member includes
a second connecting portion to which the other end portion of the linear member is connected,
a second body portion that is formed continuously from and integrally with the second connecting portion,
a second coupling portion
that extends from the second body portion in a direction away from the second connecting portion, and
that has a fish-hook shape to be coupled to the first coupling portion, an insertion-and-removal opening portion
that communicates with an inside space portion of the second coupling portion, and
that allows a part of the first coupling portion to pass through the insertion-and-removal opening portion,
an opening-and-closing portion
that is pivotally supported by the second body portion such that the insertion-and-removal opening portion is opened and closed, and
that includes an abutment portion
which has
a substantially L-shape or
a substantially circular-arc shape, and
which is brought into abutment against an outer peripheral surface of the second coupling portion,
a proximal end portion that is pivotally supported by the second coupling portion,
a closure portion
that is arranged between the proximal end portion and the abutment portion, and
that closes the insertion-and-removal opening portion, and
lateral cover portions that are formed integrally with the proximal end portion and the closure portion,
which extend in a manner of jettying to an inside from at least parts of the proximal end portion and the closure portion in a side view of the second clasp member, and
which include restriction rim portions that are formed while being inclined or curved such that a space portion to be formed between the lateral cover portions and a coupling part of the closure portion and the abutment portion forms an angle less than 90°, and
a locking portion
that locks the opening-and-closing portion when the second coupling portion is brought into abutment against the opening-and-closing portion, and
that maintains a state of the abutment.

15. The clasp for the accessory according to claim 14, wherein
the locking portion includes a locking recess portion that is provided in a recessed manner in a portion of the outer peripheral surface of the second coupling portion, and a protruding-portion-to-be-locked
that is provided to the abutment portion, and
that is inserted into the locking recess portion.

16. The clasp for the accessory according to claim 14, wherein,
when the opening-and-closing portion is brought into abutment against the second coupling portion, the second coupling portion and the opening-and-closing portion are inserted through the insertion hole portion of the first clasp member.

17. The clasp for the accessory according to claim 14, wherein
the second clasp member includes a protruding piece portion that protrudes from an outer peripheral surface of the abutment portion to an outside, and
the protruding piece portion is closer to the first clasp member than to the second connecting portion when the abutment portion has been held in abutment against the second coupling portion.

18. The clasp for the accessory according to claim 14, wherein a gap is formed between a distal-end post portion of the second coupling portion and the restriction rim portions, the gap being smaller than a thickness of the first coupling portion.

* * * * *